US010722930B2

(12) United States Patent
Luckey, Jr. et al.

(10) Patent No.: US 10,722,930 B2
(45) Date of Patent: Jul. 28, 2020

(54) COOLING OF DIES USING SOLID CONDUCTORS

(71) Applicant: Ford Global Technologies, LLC, Dearborn, MI (US)

(72) Inventors: S. George Luckey, Jr., Dearborn, MI (US); Feng Ren, West Bloomfield, MI (US); Daniel Quinn Houston, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 803 days.

(21) Appl. No.: 15/384,669

(22) Filed: Dec. 20, 2016

(65) Prior Publication Data

US 2018/0169730 A1 Jun. 21, 2018

(51) Int. Cl.
*B21D 22/00* (2006.01)
*B21D 22/02* (2006.01)
(Continued)

(52) U.S. Cl.
CPC ..... *B21D 22/022* (2013.01); *B21D 37/16* (2013.01); *B22D 19/00* (2013.01); *B22D 19/06* (2013.01);
(Continued)

(58) Field of Classification Search
CPC ..... B21D 24/16; B21D 37/16; B21D 22/022; B21D 22/208
See application file for complete search history.

(56) References Cited

U.S. PATENT DOCUMENTS 7,351,054 B2 4/2008 Bachan
8,215,147 B2 7/2012 Horton et al.
(Continued)

FOREIGN PATENT DOCUMENTS

CN 105934292 A 9/2016
EP 2309008 A2 4/2011
EP 2842711 A1 3/2015

OTHER PUBLICATIONS

Composite World: Tooling, https://www.compositesworld.com/articles/tooling, 12 pages. (Year: 2016).*
(Continued)

*Primary Examiner* — Debra M Sullivan
(74) *Attorney, Agent, or Firm* — Vincent Mastrogiacomo; Brooks Kushman P.C.

(57) ABSTRACT

Dies for forming components, such as sheet components, and methods of producing the dies are disclosed. The die may include a bulk material and a forming surface. A solid conductor may be formed in the bulk material. The solid conductor may be spaced from and extend adjacent to the forming surface and have a melting point that is greater than a melting point of the bulk material. The solid conductor may be configured to absorb heat from the forming surface. There may multiple solid conductors within the bulk material, for example spaced apart and extending along an axis. The solid conductor may be a bundle of carbon fibers, which may be pitch-based. The solid conductor may be conformal to the forming surface, for example, having a constant spacing therefrom. The solid conductor may be cast-in to the die during its production.

17 Claims, 5 Drawing Sheets

(51) Int. Cl.

| | |
|---|---|
| ***B22D 19/00*** | (2006.01) |
| ***B22D 25/02*** | (2006.01) |
| ***C21D 7/13*** | (2006.01) |
| ***C21D 1/673*** | (2006.01) |
| ***B21D 37/16*** | (2006.01) |
| ***F28F 21/02*** | (2006.01) |
| ***F28F 7/02*** | (2006.01) |
| ***B22D 19/06*** | (2006.01) |
| *B21D 37/20* | (2006.01) |
| *F28D 21/00* | (2006.01) |
| *F28F 13/00* | (2006.01) |

(52) U.S. Cl.

CPC ..... *B22D 25/02* (2013.01); *C21D 1/673* (2013.01); *C21D 7/13* (2013.01); *F28F 7/02* (2013.01); *F28F 21/02* (2013.01); *B21D 37/20* (2013.01); *F28D 2021/0029* (2013.01); *F28F 2013/006* (2013.01)

(56) References Cited

U.S. PATENT DOCUMENTS

| | | | | |
|---|---|---|---|---|
| 2009/0320547 | A1 | 12/2009 | Horton et al. | |
| 2016/0024608 | A1 | 1/2016 | Singh et al. | |
| 2016/0339546 | A1* | 11/2016 | Sung ..... | B23P 15/24 |

OTHER PUBLICATIONS

Xu et al., "Designing Conformal Cooling Channels for Tooling", MIT, Cambridge, MA, 16 pages.

* cited by examiner

COOLING OF DIES USING SOLID CONDUCTORS

TECHNICAL FIELD

The present disclosure relates to the cooling of dies using solid conductors, for example, using cast-in carbon fibers.

BACKGROUND

Hot stamping is a metal forming process that may include heating an article or component to be formed and then stamping the article while it is still at an elevated temperature. For example, when hot stamping a steel article, the article may be heated to a temperature at which the microstructure of the steel is converted to austenite (e.g., austenitizing). This temperature may be around 900-950° C., depending on the composition of the steel. In some hot stamping processes, the dies of the stamping mold that provide the desired shape to the stamped article may be cooled. The cooled dies may cool the article as it is being stamped and/or immediately after it is stamped. If the cooling rate of the dies is sufficiently high, the microstructure of the stamped article may be converted to a high strength phase. In the case of steel components, a sufficient cooling rate may result in a martensitic microstructure. Hot stamping may also be used to form articles made from other metals, such as aluminum. For example, aluminum alloys may be solution heat treated and quenched using a hot stamping process.

SUMMARY

In at least one embodiment, a mold die is provided. The die may include a bulk material and a forming surface; and a solid conductor spaced from and extending adjacent to the forming surface and having a melting point that is greater than a melting point of the bulk material, the solid conductor configured to absorb heat from the forming surface.

The solid conductor may have a substantially constant spacing from the forming surface. In one embodiment, the solid conductor has a substantially constant spacing from the forming surface in a region where the forming surface is non-planar. The solid conductor may be integrally formed within the bulk material. In one embodiment, the solid conductor includes a bundle of fibers having a thermal conductivity of at least 400 W/mK. The solid conductor may be a bundle of carbon fibers, which may be pitch-based carbon fibers.

In one embodiment, the die includes a plurality of solid conductors spaced from and extending adjacent to the forming surface, each having a melting point that is greater than the melting point of the bulk material and being configured to absorb heat from the forming surface. The plurality of solid conductors may extend along a first axis and be a first set of solid conductors. The first set of solid conductors may be evenly spaced apart. A second set of solid conductors, spaced from and extending adjacent to the forming surface, may extend along a second axis that is non-parallel to the first axis such that the first set of solid conductors intersects the second set of solid conductors. In one embodiment, the solid conductor is a first solid conductor and the die further includes a second solid conductor in contact with the first solid conductor at a first end and configured to be cooled by a liquid coolant at a second end, the second solid conductor configured to transport heat from the first solid conductor to the liquid coolant, thereby cooling the forming surface. In another embodiment, the plurality of solid conductors are a first set of solid conductors and the die further includes a second set of solid conductors that are each in contact with one of the first set of solid conductor at a first end and extend into a bath at a second end, where the second end is configured to be cooled by a flowing liquid coolant.

In at least one embodiment, a mold die is provided. The die may include a bulk material and a forming surface; and a plurality of spaced apart bundles of carbon fiber integrally formed in the bulk material, each bundle spaced from the forming surface and configured to absorb heat from the forming surface.

Each bundle of carbon fiber may extend adjacent to the forming surface and have a substantially constant spacing from the forming surface. In one embodiment, the plurality of bundles extend along a first axis and are a first set of bundles and a second set of spaced apart bundles of carbon fiber, spaced from and extending adjacent to the forming surface, extends along a second axis that is non-parallel to the first axis such that the first set of bundles intersects the second set of bundles.

In at least one embodiment, a method is provided. The method may include positioning an elongated solid conductor in a mold for a die having a forming surface, the solid conductor having a first melting point; and casting a die material having a second melting point lower than the first melting point into the mold such that the die material fully encapsulates at least a portion of the elongated solid conductor.

The positioning step may include positioning the elongated solid conductor in the mold such that after the casting step, the elongated solid conductor extends adjacent to the forming surface. In one embodiment, the positioning step includes positioning the elongated solid conductor in the mold such that after the casting step, the elongated solid conductor has a substantially constant spacing from the forming surface. The elongated solid conductor may include a bundle of carbon fiber.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As described in the Background, hot stamping is a process in which an article or component may be heated to an elevated temperature and then stamped into a desired shape while the article remains at an elevated temperature. In some embodiments, the stamping dies used in the process may be cooled such that the stamped article is cooled during the stamping process. Cooled dies may be used to determine the microstructure of the stamped article. For example, when hot stamping a steel article, the article may be heated (e.g., in a furnace/oven) to a temperature at which the microstructure of the steel is converted to austenite from a ferritic-pearlitic microstructure (e.g., austenitizing). This temperature may be around 900-950° C., depending on the composition of the steel. During the hot stamping process, the cooled dies may quench the article to form martensite. As is known in the art, martensite is a very strong/hard phase of steel that is formed by a diffusionless transformation during rapid quenching from an austenitic phase.

Similarly, hot stamping may be used to simultaneously solutionize and quench an age hardenable aluminum alloy, such as the 2xxx, 6xxx, or 7xxx series of aluminum alloys. The aluminum article may be heated to a solutionizing temperature wherein only a single phase is present. During stamping the cooled dies may quench the article such that the single phase is unable to dissociate into two or more phases by diffusion (as would exist at equilibrium). A hot stamping process for aluminum alloy articles is described in U.S. Pat. No. 8,496,764, the disclosure of which is hereby incorporated in its entirety by reference herein. Both steel and aluminum hot stamping may include subsequent heat treatment steps to further alter the properties (e.g., mechanical properties—strength, ductility, toughness, etc.) of the article. While steel and aluminum articles have been described, hot stamping may be applicable to any material in which the article is first heated and then rapidly cooled.

Figure 1:
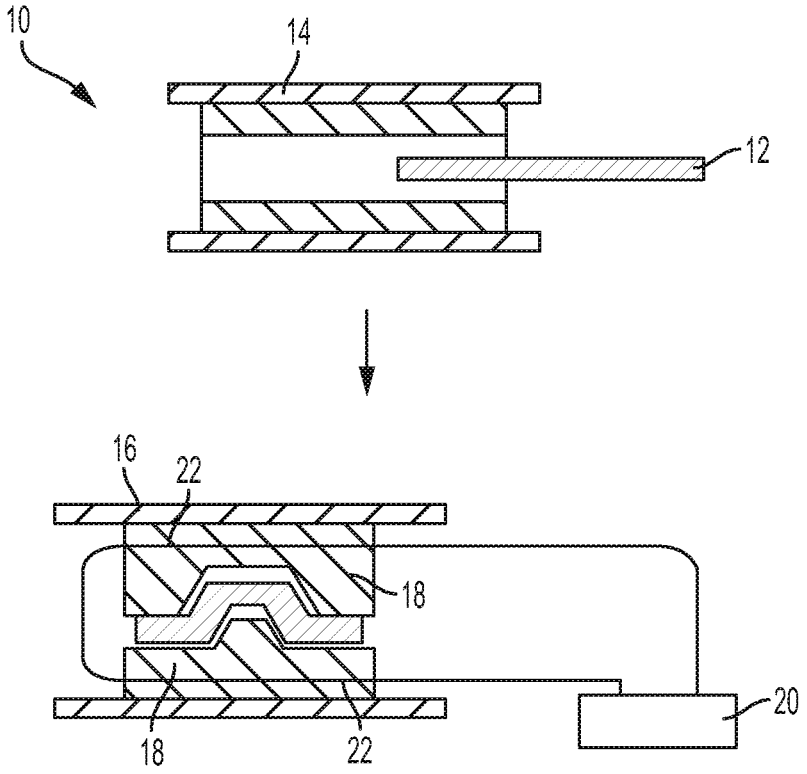
FIG. 1 Prior Art
FIG. 1 is a schematic example of a hot stamping system.

With reference to FIG. 1, an example of a hot stamping system 10 is shown. In a first step, an article 12, such as a steel or aluminum sheet, may be heated in a furnace or oven 14. When the article has been heated to a certain temperature, for example, an austenitizing or solutionizing temperature, it may be removed from the furnace 14 and quickly transferred to a stamping mold 16. The mold 16 may include two or more dies 18, which may cooperate to form a die cavity having the desired article shape. The dies 18 may be urged together to form the article 12 into the desired shape. One, some, or all of the dies 18 may be cooled during the stamping process to quench the article 12. As shown in FIG. 1, a liquid coolant 20, such as water, may be circulated through channels 22 in the dies 18.

These channels 22 are typically straight channels, as illustrated. The straight channels may be formed using a gun drill, or any other suitable deep-drilling method. Since the drilling methods form straight-line bores, each channel 22 can only be either a single, straight-line channel or a combination of multiple connected/intersecting straight-line channels. For a mold having a complex die cavity (e.g., having at least one non-flat surface), this may make it difficult or impossible to have conformal cooling channels that closely follow the surface contours of the die cavity. For example, straight-line channels cannot have curves or tight corners (e.g., low radius). Instead, straight-line cooling channels may have a varying and non-constant distance from the forming surface of the die. This may result in temperature variations or gradients on the forming surface and in the cooling component during the hot stamping and quenching process. Such fluctuations in temperature can cause inconsistencies in the microstructure and mechanical properties in the quenched component. For example, a steel component that is austenitized and then quenched at different rates and/or to different temperatures throughout the component may have varying levels of martensite in the quenched component (e.g., areas with faster/greater cooling may have a larger martensitic conversion).

Figure 2:
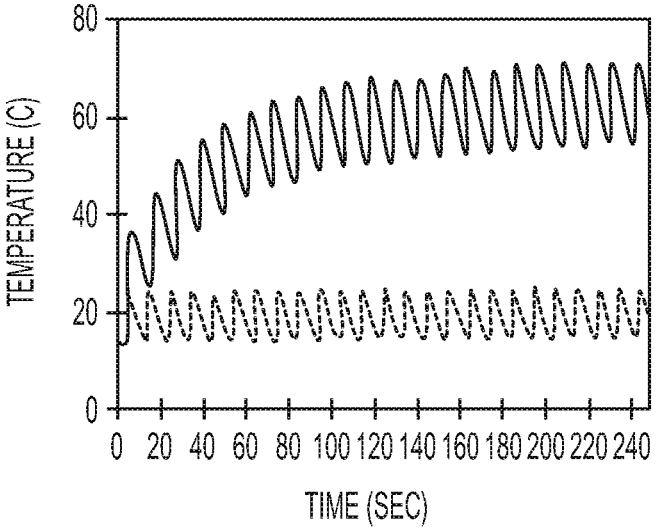
FIG. 2 is a schematic plot of mold surface temperature for straight-line (solid line) and conformal (dotted line) cooling channels.

With reference to FIG. 2, a schematic comparison of mold surface temperature for molds with straight channel cooling (solid line) and conformal channel cooling (dotted line). The top line represents a straight channel cooling system and the bottom line represents a conformal channel cooling system. Each line has alternating peaks and valleys, with the peaks representing the start of a stamping/forming cycle when the mold surface contacts the hot workpiece and the valleys representing the end of the cycle when the workpiece is cooled and removed. As shown, in the straight channel cooling system, heat builds up in the mold over time as multiple cycles are performed. This is a result of the straight line cooling channels not effectively removing heat from the mold surface during each cycle. At a certain point (about 200 seconds in FIG. 2), the system may reach an equilibrium or steady-state where the minimum and maximum temperature of the mold surface evens out or plateaus. In contrast, the bottom line shows that a conformal cooling channel system may more effectively remove heat from the mold surface and prevent heat from building up on the surface over time. As shown, the conformal channel system maintains a substantially constant temperature profile over time.

As described above, it is very difficult to have true conformal liquid cooling channels for a non-flat mold forming surface. For complex molds, particularly those more than two dies or with highly curved molding surfaces, having truly conformal liquid cooling channels may be impossible. As used herein, "truly conformal" may refer to a cooling channel wherein a spacing of the channel (e.g., the channel center) to the mold forming surface is constant or substantially constant. For example, the channel may stay within ±5% or 10% of an average spacing or from a pre-determined spacing or it may stay within a certain length tolerance, such as ±1 mm or 2 mm.

Figure 3:
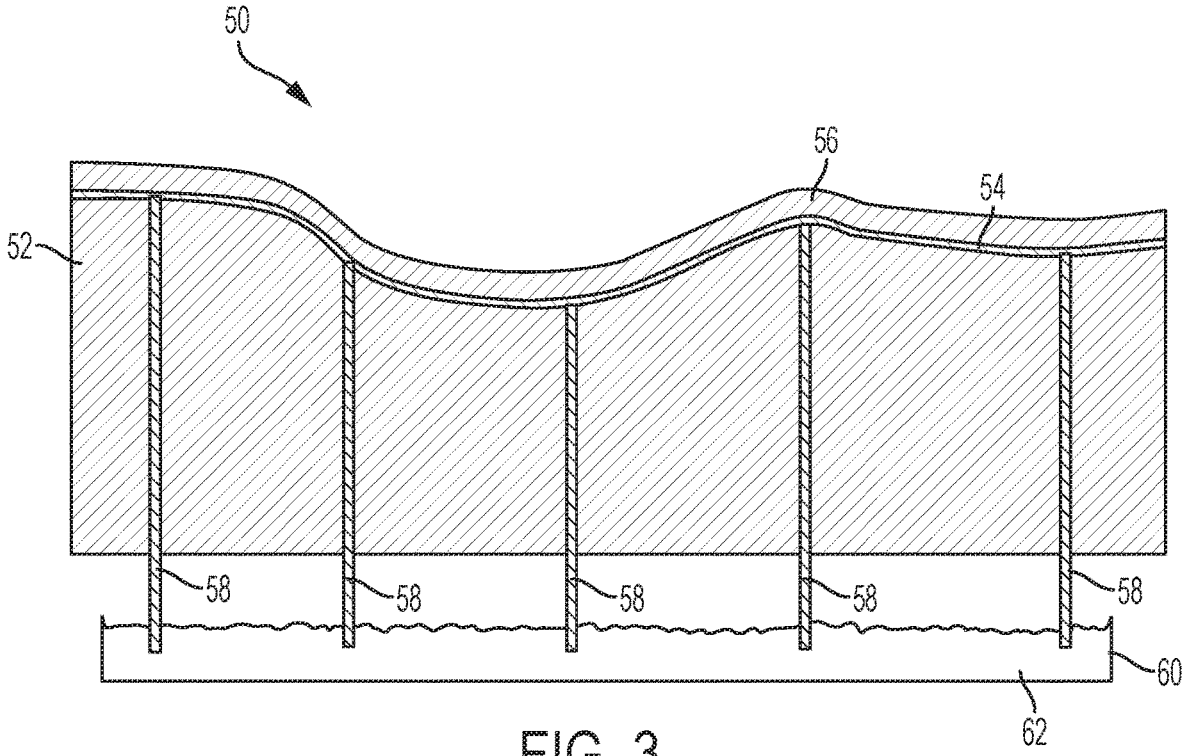
FIG. 3 is a side cross-section of a stamping die having a solid thermal conductor bundle included therein that is conformal to the forming surface, according to an embodiment.

With reference to FIG. 3, a different mold cooling approach has been developed that may provide conformal cooling even with complex mold designs. A mold 50 is provided having two or more dies 52. One die 52 is shown in FIG. 3, and one or more additional dies (not shown) may correspond with the die 52 to form a mold cavity. As understood by one of ordinary skill in the art, there are numerous ways for mold dies to be arranged and configured to form a mold cavity that corresponds to the shape of a desired component to be formed.

In at least one embodiment, the die 52 includes one or more high-temperature materials formed therein. The high-temperature material may be cast-in to the die during the formation of the die 52 itself. Accordingly, the high-temperature material may be integrally formed with the die 52 (e.g., the cast material may solidify around the high-temperature material and conform to it). The cast material may mechanically interlock with the high-temperature material, for example, by filling any crevices, depressions, or other forms of surface roughness. If the high-temperature material includes a plurality of fibers, the cast material may at least partially penetrate the spaces between the fibers and/or encapsulate some of the fibers, such as the outer fibers in a bundle. Depending on the chemistries of the cast material and the high-temperature material, there may be chemical bonding between the two materials.

The high-temperature material may be a material having a higher melting point than the material from which the bulk of the die is made or higher than a temperature at which the die material is cast. For example, H13 steel is a material used for dies and it has a melting point of about 1427° C. and it may be cast in liquid form at a temperature of about 1600° C. Accordingly, the high-temperature material included in a die of H13 steel may have a melting temperature of over 1427° C. or over 1600° C. such that it may survive being cast-in to the die without melting. In one embodiment, the high-temperature material may have a melting point of at least 50° C., 100° C., 200° C., or 300° C. above the melting and/or casting temperature of the die bulk material. In another embodiment, the high-temperature material may have a melting point of at least 1,000° C., 1,500° C., 1,750° C., or 2,000° C.

In addition to having a high melting point, the high-temperature material(s) may also have a high thermal conductivity, which may be higher than the die bulk material. Again using H13 steel as an example, it has a thermal conductivity of about 25 W/mK. Accordingly, the high-temperature material may have a thermal conductivity that is greater than 25 W/mK. In one embodiment, the high-temperature material may have a thermal conductivity of at least 50 W/mK, such as at least 100 W/mK, 200 W/mK, 300 W/mK, 400 W/mK, 500 W/mK, 600 W/mK, 700 W/mK, 800 W/mK, or 900 W/mK. In one embodiment, the high-temperature material may have a thermal conductivity of 250-1000 W/mK, or any sub-range therein, such as 300-1,000 W/mK, 400-1,000 W/mK, or 500-1,000 W/mK. For reference, copper has a thermal conductivity of about 400 W/mK. Accordingly, the high-temperature material may have a thermal conductivity that is greater than copper's.

The high-temperature material may therefore have both a high melting point and a high thermal conductivity. These properties may allow for the material to be cast-in to the die without melting and also to conduct heat away from the die at a greater rate than the bulk die material. The high-temperature material may be included in the die 52 in the form of a cable, cord, rod, wire, bundle, string, mesh, web, network, or net. In at least one embodiment, the high-temperature material may be flexible prior to being cast-in to the die.

One example of a suitable high-temperature material is carbon fiber. However, depending on the application, only certain types of carbon fiber may be suitable due to the differing properties between fibers made by different processes. For example, pitch-based carbon fibers generally have a very high melting point and thermal conductivity. In contrast, PAN-based carbon fibers generally have a lower melting point and/or thermal conductivity than pitch-based fibers. In addition to pitch-based carbon fibers, other forms of carbon may also produce high melting point and high thermal conductivity fibers, such as those including graphene or carbon nanotubes. Carbon fibers generally have small diameters (e.g., on the order of nm or μm) and are not typically used individually. Therefore, the carbon fibers may be bundled, spun, or otherwise grouped into a larger diameter cords or cables.

Materials that have both a high melting point and high thermal conductivity are relatively rare, since many materials may have only one (or none) of these properties. For example, copper has high thermal conductivity (about 400 W/mK), but has a relatively low melting point (for a metal) of 1,085° C. Accordingly, copper may not be able to be cast-in to many other metals, such as the steels used for many dies (e.g., H13), because it would melt during the process. Materials that meet these requirements and that are flexible are currently even fewer. However, any material that meets these properties, currently available or in the future, may be suitable for use with the present disclosure. Carbon fiber may be used in the present disclosure as an exemplary high-temperature material, however, unless specifically stated, any reference to carbon fiber may be substituted for another material that meets the above properties.

As shown in FIG. 3, the die 52 may be formed with one or more bundles 54 of carbon fiber included therein. As described above, the bundle(s) 54 may be cast-in to the bulk material of the die 52 (e.g., steel). Accordingly, the bundle(s) may be integrally formed with the die material such that there is mechanical and/or chemical bonding between the bulk material and at least a portion of the carbon fibers (e.g., the surface). As the bundle may be cast-in, the bonding may be present without any adhesive.

The bundles 54 may be spaced from the forming surface 56 of the die 52 and may extend adjacent to the forming surface 56 (e.g., run alongside it or follow the same contour but spaced apart, as shown in FIG. 3). Because the bundles 54 may be flexible, they may be positioned within the mold in a curved or non-straight manner when the die 52 is cast. Accordingly, the bundles 54 may be positioned such that they are conformal or parallel to the forming surface of the die 52. As described above, conformal may mean that the spacing of the bundle to the mold forming surface is constant or substantially constant. Since the bundles 54 have a higher melting temperature than the molten metal (or other mold material), the bundles may be positioned within the mold and may retain their shape and position in the mold during the casting process. Accordingly, a plurality of bundles 54 may be positioned in the mold in conformal positions with the die forming surface and the resulting die 52 may have formed therein the bundles 54 in conformal positions.

As shown in the example of FIG. 3, the forming surface 56 of the die 52 may be a non-flat or non-planar surface. In some embodiments, the forming surface 56 may be complex and may have one or more curved surfaces. As described above, it may be very difficult or impossible to create conformal water channels for such a non-planar forming surface. Gun drills create only straight-line channels, therefore, curved surfaces or tight corners can only at best be approximated using multiple straight segments. In contrast, the disclosed mold 50 may replace some or all liquid cooling channels with a solid thermal conductor that draws heat away from the forming surface 56. The solid thermal conductor may be integrally formed in the die during casting, allowing for conformal "channels" of the solid material to be positioned in a precise manner and without machining after the die is cast.

Figure 4:
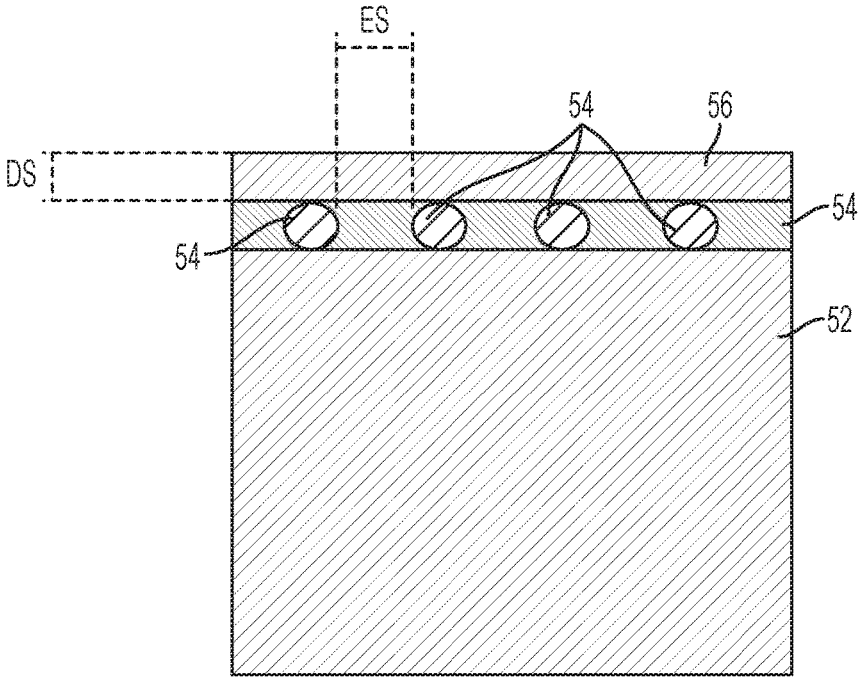
FIG. 4 is an end cross-section of the stamping die of FIG. 3, according to an embodiment.

With reference to FIGS. 3 and 4, a plurality of bundles 54 of carbon fiber (or other suitable material) may be included in the die 52. One, a portion, or all of the bundles 54 may be conformal to the forming surface 56. FIG. 3 shows a side cross-section of the die 52 showing a single bundle 54 that is conformal to the forming surface 56. FIG. 4 shows an end cross-section of the die 52 of FIG. 3. As shown in FIG. 4, there may be multiple bundles 54 extending along a length of the die 52 (e.g., the direction of the bundle in FIG. 3). The bundles may be substantially parallel to each other and may have a spacing therebetween. The spacing between the longitudinal bundles 54 is shown as an edge-to-edge spacing, or ES. The spacing may be constant or substantially constant (e.g., ±10%) along the length of the die 52. In one embodiment, the spacing (ES) may be from 5-20 mm, or any sub-range therein, such as 5-15 mm, 7-13 mm, 8-12 mm, 9-11 mm, or about 10 mm (e.g., ±1 mm). However, the spacing may vary depending on the properties of the particle material in the bundles 54, the size/diameter of the bundles 54, the configuration of the bundles 54 (e.g., number and/or placement), the degree of cooling necessary, or others.

In addition to the spacing between the bundles 54, another parameter may be the distance from the bundle(s) 54 to the forming surface 56, or DS. As described above, for bundles 54 that are conformal to the forming surface 56, the DS may be substantially constant along a length of the bundle 54, at least along a portion of the bundle 54. In one embodiment, the distance DS may be from 3-25 mm, or any sub-range therein, such as 3-20 mm, 6-20 mm, 3-10 mm, 3-15 mm, 6-15 mm, or about 10 mm (e.g., ±1 mm). While a smaller spacing from the forming surface 56 may provide increased heat transfer, if the spacing is too small structural issues may arise in the die surface. A third parameter of the solid thermal material cooling system may be the width/diameter/thickness of the bundles 54. The bundles 54 are shown as having a circular cross-section, however, the bundles may have any suitable cross-section, such as square, rectangular, oval, triangular, irregular, or others. In one embodiment, the bundles 54 may have a width of 3-25 mm, or any sub-range therein, such as 3-20 mm, 5-20 mm, 3-10 mm, 3-15 mm, 5-15 mm, 5-10 mm, or about 8 mm (e.g., ±1 mm).

In at least one embodiment, there may be sets of bundles 54 extending in multiple directions. As shown in FIGS. 3 and 4, there may be one set of bundles 54 extending in a longitudinal direction of the die 52. In addition, as shown in FIG. 4, there may be another set of bundles 54 extending perpendicular or generally perpendicular to the first set of bundles 54. This may form a network of intersecting bundles 54. In the example shown, the network may be a square grid of perpendicular sets of bundles 54, however, other patterns or configurations are also contemplated. For example, the network may have a spider-web shape or the sets of bundles 54 may intersect at angles that are less or more than 90 degrees. The intersecting bundles 54 may also be referred to as a mesh or lattice. In another embodiment, the intersecting bundles 54 may be replaced by a sheet of carbon fiber (or other solid conductor material). Similar to the bundles 54, the sheet may be positioned such that it is conformal to the forming surface 56. A sheet may be defined as having length and width directions that greatly exceed a thickness direction and may have two opposing major surfaces (e.g., top and bottom). These major surfaces may be the surfaces that are conformal to the forming surface 56.

Networked or intersecting bundles 54 of carbon fiber may provide even greater heat removal from the forming surface 56, and may provide more uniform cooling of the surface. The ability to form networked bundles is another benefit unique to the disclosed solid thermal conductor cooling system. As described above, drilling channels for liquid cooling is very difficult and generally only straight-line channels can be formed that at best roughly approximate the forming surface. It would be extremely difficult or impossible to drill cross-channels that intersect these channels to connect them and form a network or grid like that disclosed above. In contrast, the disclosed bundles 54 of carbon fiber or other high-temperature material may be arranged and positioned within the mold of a die prior to casting, making the networked configuration relatively easy to implement.

In addition, liquid cooling channels generally require separate inlet and return channels to deliver the coolant to the site and then remove it. Another benefit of the disclosed solid thermal conductor cooling system is that thermal conduction may take place along a single bundle. This may allow for an increased number of heat-removing bundles 54 to be included in the die 52 nearing the forming surface 56, since return channels may not be necessary.

The disclosed solid thermal conductor cooling system may be used in place of, or in addition to, conventional liquid cooling (or any other cooling system). For example, if a die has a very complex surface shape overall, then the solid thermal conductors (e.g., carbon fiber bundles) may be the primary or only cooling mechanism. In other circumstances, if straight-line cooling is feasible or practical for portions of the die, then a combination of liquid cooling and solid conductor cooling may be used. These are merely examples, however, and the solid conductor system may be used even for non-complex die shapes.

With reference to FIG. 3, an additional set of bundles 58 may be included in the die 52 to transfer/remove heat from the bundles 54 to cool the forming surface 56. The bundles 58 may be the same or similar to bundles 54 from a composition and/or thermal properties perspective and may have similar sizes and/or spacing to the values described above. One end of the bundles 58 may contact one or more bundles 54 that are near or conformal with the forming surface 56. The other end of the bundles 58 may be in contact with a coolant or any suitable heat sink able to rapidly remove heat from the bundles 58 and, by conduction, bundles 54. The bundles 58 may be cast-in to the die 52, in a manner similar to bundles 54. Or, in the alternative, the bundles 58 may be inserted after the die has been case by drilling into the die and feeding the bundles 58 through the created channels. In embodiments where the bundles 58 are inserted after casting, materials with lower melting temperatures may be used (e.g., copper) and/or non-flexible materials may be used (e.g., rods).

In one embodiment, one end of the bundles 58 may be cooled by water, or another liquid coolant. In the embodiment shown in FIG. 3, a pool, or tank, or bath 60 may hold a liquid coolant 62, such as water. At least a portion of the bundles 58 (e.g., the ends) may be immersed or submerged in the bath 60 such that the coolant 62 may remove heat energy from the bundles 54 via the bundles 58. The heat removed from the submerged portion of the bundles 58 may create a heat gradient within the bundles 58 such that heat from the bundles 54 near the forming surface is caused to flow through the bundles 58 to the bath 60. The coolant 62 in the bath 60 may be kept at or below a certain temperature in order to provide sufficient cooling capacity to the bundles 54 and 58. This maximum coolant temperature may be referred to as the boundary condition.

In order to rapidly cool the bundles 58 and continue to cool them, the coolant 62 may be a moving coolant, such as flowing water. The bath 60 may have an inlet and outlet such that the coolant may flow through the bath 60. The coolant 62 may be circulated through the bath 60, for example, after running through a heat exchanger to remove the heat absorbed from the bundles 58. In embodiments with both liquid cooling and solid thermal conductors, the coolant 62 may be the same coolant used to cool the forming surface 56 through coolant channels. However, the coolant 62 may also be a separate coolant system. While the heat from the bundles 58 is shown and described as being removed from a bath 60 using liquid coolant 62, any suitable method may be used to remove said heat. For example, the bundles 58 may contact a cold plate that is maintained at a certain max temperature or below. In one embodiment, the boundary condition may be maintained at a temperature of no more than 15° C., such as less than or equal to 10° C., 8° C., or 6° C.

Figure 5:
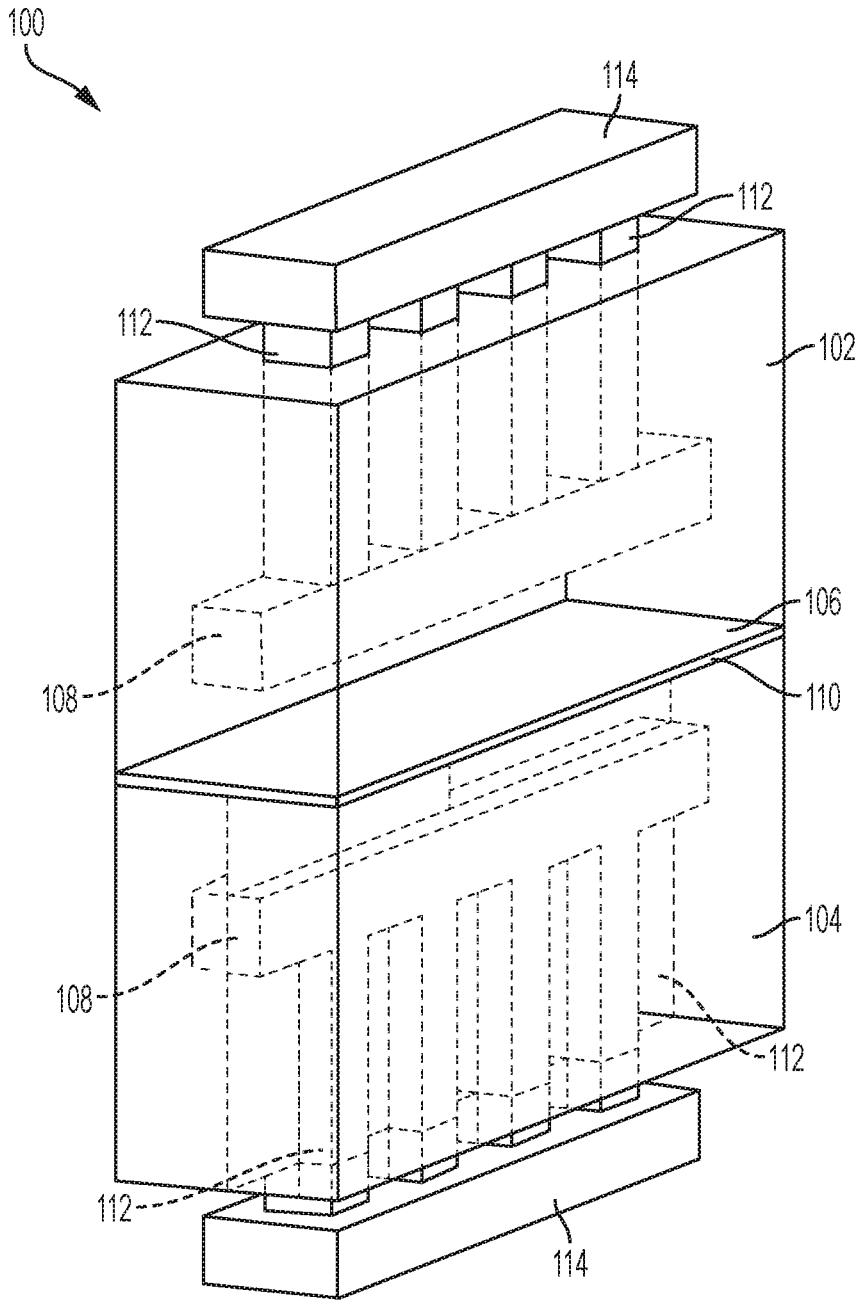
FIG. 5 is a perspective view of a finite element analysis (FEA) model of a die having a solid thermal conductor bundle included therein that is conformal to the forming surface, according to an embodiment.

With reference to FIGS. 5-8, a finite element analysis (FEA) model and resulting data are shown indicating that the disclosed solid thermal conductor cooling system is effective. With reference to FIG. 5, a mold 100 is shown having an upper die 102 and a lower die 104. The dies cooperate to form a blank 106 into a component. Each die includes a carbon fiber bundle 108 running adjacent to the forming surface 110 of the die at a constant spacing (in this example, 10 mm). In addition, a plurality of carbon fiber bundles 112 extend in a perpendicular direction from the bundle 108 to remove heat therefrom. The ends of the bundles 112 are in contact with a cooling source 114 represented by a boundary condition. In this example, the boundary condition was set to a max temperature of 6° C.

Figure 6:
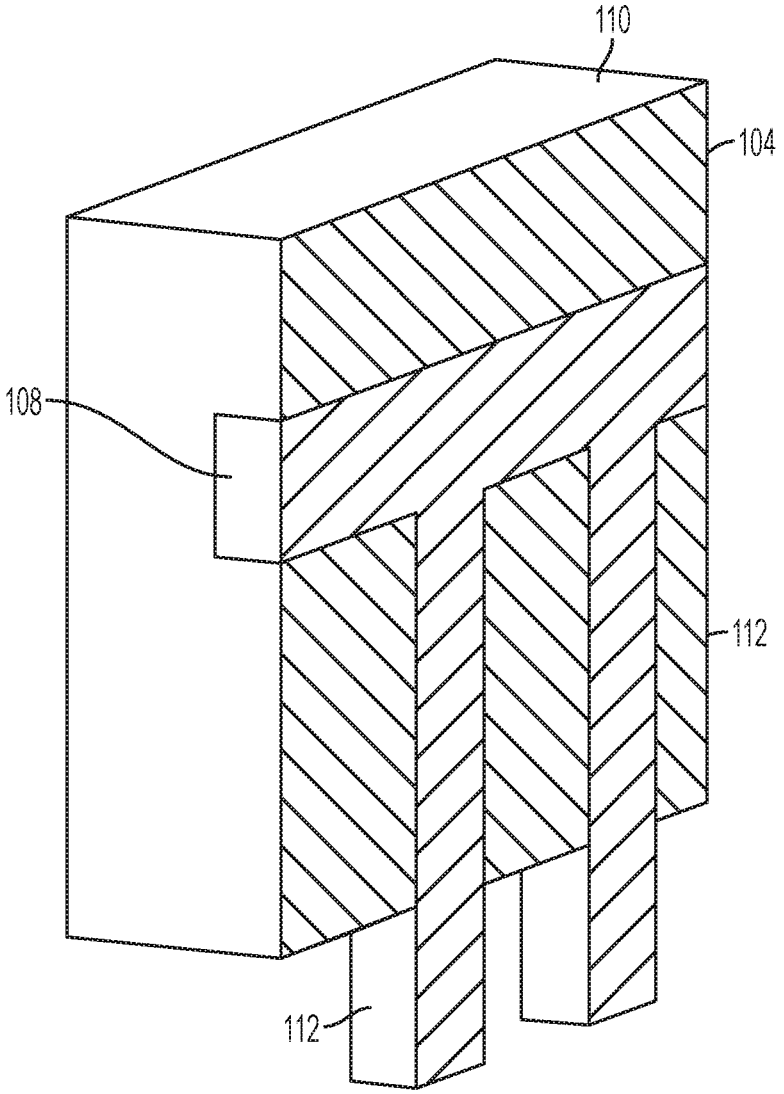
FIG. 6 is a perspective section view of the bottom die of FIG. 5.

FIG. 6 shows a partial perspective cross-section of the lower die 104. In this example, the bundles 108 and 112 are modeled with a square cross-section having a width of 8 mm (4 mm in the cross-section). The top edge of the bundle 108 is spaced 10 mm from the forming surface 110 and the bundles 112 are spaced 10 mm, edge-to-edge. The dies 102 and 104 were modeled as H13 steel having a thermal conductivity of 25 W/mK and the bundles 108 and 112 were modeled as pitch carbon fiber having a thermal conductivity of 900 W/mK.

Figure 7:
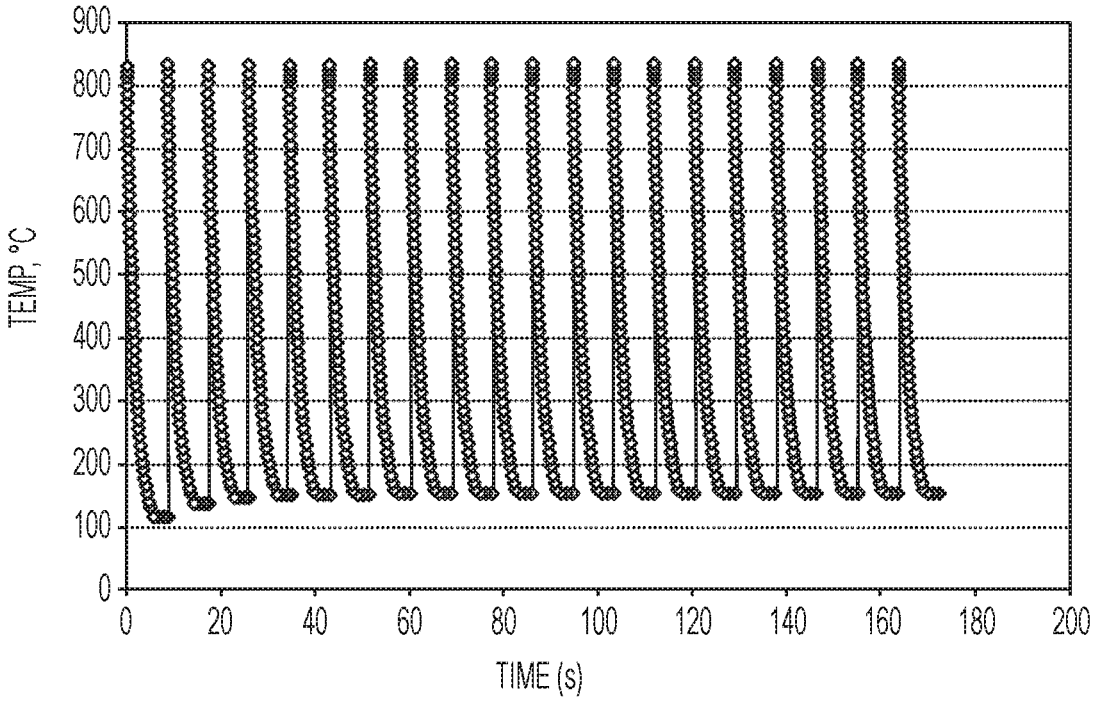
FIG. 7 is a plot of a sheet blank temperature during multiple stamping cycles according to the FEA.
Figure 8:
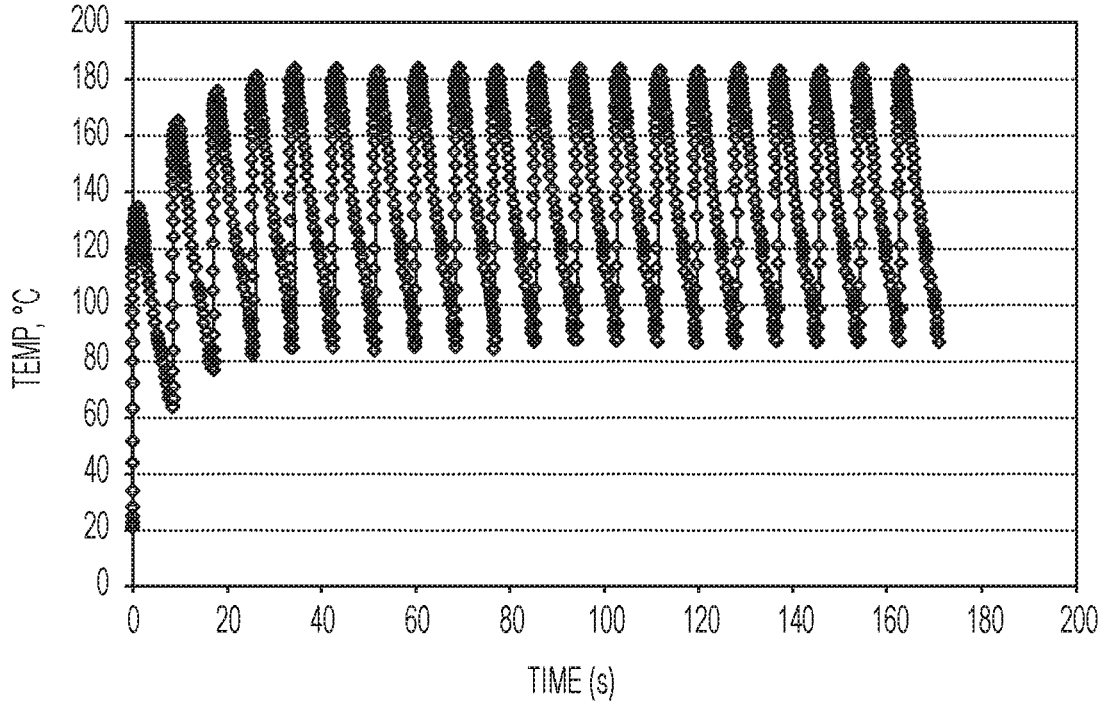
FIG. 8 is a plot of the die forming surface temperature during multiple stamping cycles according to the FEA.

With reference to FIGS. 7 and 8, FEA data is shown regarding the temperature of a 18 mm wide blank sheet of 1.5 mm steel and the temperature of the forming surface of the die, respectively. The temperature of the air in the model was 20° C., as was the initial temperature of the die. The temperatures in the blank and in the forming surface were modeled for repeated stamping cycles having a quench time of 5.63 seconds and an air time of 3 seconds. As shown in FIG. 7, the temperature of the steel blank was successfully brought down from over 830° C. to just over 100° C. during the first quench. During subsequent cycles the blank is brought down to a temperature that is slightly higher than the first cycle, but the final temperature quickly plateaus at a value of about 150° C. and stays there for the duration of the model test.

With reference to FIG. 8, the temperature of the forming surface of the die is shown as a function of time during repeated stamping cycles. In the first cycle, the die surface goes from room temperature up to almost 140° C. when contact is first made with the hot blank. The system of carbon fiber bundles then quickly cooled the die surface to just over 60° C. by the end of the first cycle. The maximum and minimum temperatures of the die surface increased over the next several cycles, but then the maximum temperature leveled out at a little over 180° C. and the minimum temperature leveled out at a little over 80° C. The data in FIGS. 7 and 8 is similar to that shown for the conformal cooling in FIG. 2 in that the forming surface temperature very quickly levels out and does not exhibit continuous accumulation of heat for many cycles. The FEA data therefore supports the efficacy of the disclosed solid thermal conductor cooling system.

Accordingly, the present disclosure provides a cooling mechanism for hot stamping dies that includes solid thermal conductors, such as carbon fiber, to supplement or replace direct liquid cooling of the die forming surface. The cooling system has been described with respect to steel dies, however, any die type may benefit from the disclosed system, such as aluminum dies or zinc-aluminum (e.g., Kirksite) dies. In addition, dies other than hot stamping may also incorporate the claimed solid conductor cooling system, such as injection molding dies or conventional stamping dies. In general, the solid conductor cooling system may be used in any application where consistent or uniform cooling of a die surface is desired or required and/or where conformal cooling using conventional techniques is difficult or impossible.

While the die structures and methods have been described herein with respect to cooling of the dies, the same dies and methods may be used to heat a die. In applications where it may be desired to increase the temperature of a die or die surface and/or to have a more even temperature distribution in a die or die surface, the solid thermal conductors may be heated instead of cooled. For example, instead of cooling one end of a solid thermal conductor in a cold liquid bath, the end may be heated by a hot liquid bath or by other means (e.g., induction heating, hot air, flame, resistance heating, infrared, etc.).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A mold die, comprising:

a bulk material and a forming surface; and a solid conductor within the bulk material, spaced from and extending adjacent to the forming surface and having a melting point that is greater than a melting point of the bulk material, the solid conductor configured to absorb heat from the forming surface, the solid conductor is a bundle of carbon fibers.

2. The die of claim 1, wherein the solid conductor has a substantially constant spacing from the forming surface.

3. The die of claim 2, wherein the forming surface includes a non-planar region, and the solid conductor has a substantially constant spacing from the non-planar region of the forming surface.

4. The die of claim 1, wherein the solid conductor is integrally formed within the bulk material.

5. The die of claim 1, wherein the bundle of carbon fibers includes pitch-based carbon fibers.

6. The die of claim 1, wherein the bundle of carbon fibers are spaced from and extending adjacent to the forming surface, each having a melting point that is greater than the melting point of the bulk material and being configured to absorb heat from the forming surface.

7. The die of claim 6, wherein the bundle of carbon fibers extend along a first axis and are a first set of carbon fibers.

8. The die of claim 7, wherein the first set of carbon fibers is evenly spaced apart.

9. The die of claim 7, wherein the bundle of carbon fibers includes a second set of solid conductors, spaced from and extending adjacent to the forming surface, and extending along a second axis that is non-parallel to the first axis such that the first set of carbon fibers intersects the second set of carbon fibers.

10. The die of claim 1, wherein the solid conductor is a first solid conductor and the die further includes a second solid conductor in contact with the first solid conductor at a first end and configured to be cooled by a liquid coolant at a second end;

the second solid conductor configured to transport heat from the first solid conductor to the liquid coolant, thereby cooling the forming surface.

11. The die of claim 6, wherein the bundle of carbon fibers are a first set of carbon fibers and the die further includes a second set of carbon fibers that are each in contact with the first set of carbon fibers at a first end and extend into a bath at a second end, where the second end is configured to be cooled by a flowing liquid coolant.

12. A mold die, comprising:

a bulk material and a forming surface; and a plurality of spaced apart bundles of carbon fiber integrally formed in the bulk material, each bundle spaced from the forming surface and configured to absorb heat from the forming surface, wherein each bundle of carbon fiber extends adjacent to the forming surface and has a substantially constant spacing from the forming surface.

13. The die of claim 12, wherein the plurality of bundles extend along a first axis and are a first set of bundles and a second set of spaced apart bundles of carbon fiber, spaced from and extending adjacent to the forming surface, extends along a second axis that is non-parallel to the first axis such that the first set of bundles intersects the second set of bundles.

14. A mold die, comprising:

a bulk material and a forming surface; and a solid conductor within the bulk material, spaced from and extending adjacent to the forming surface and having a melting point that is greater than a melting point of the bulk material, the solid conductor configured to absorb heat from the forming surface, the solid conductor including a bundle of fibers having a thermal conductivity of at least 400 W/mK.

15. The mold die of claim 14, wherein the solid conductor has a substantially constant spacing from the forming surface.

16. The mold die of claim 14, wherein the forming surface includes a non-planar region, and the solid conductor has a substantially constant spacing from the non-planar region of the forming surface.

17. The mold die of claim 14, wherein the solid conductor is integrally formed within the bulk material.

* * * * *